United States Patent [19]

Bradley

[11] Patent Number: 4,468,053

[45] Date of Patent: Aug. 28, 1984

[54] INSERTED LABELS - ADDRESS BOOK

[76] Inventor: Velma L. Bradley, 503 2nd St., Naches, Wash. 98937

[21] Appl. No.: 371,567

[22] Filed: Apr. 26, 1982

[51] Int. Cl.[3] ..... B42D 1/08

[52] U.S. Cl. ..... 281/31; 281/1; 281/15 R; 40/405; 40/537

[58] Field of Search ..... 281/15 R, 31, 1; 40/159, 405, 537

[56] References Cited

U.S. PATENT DOCUMENTS 2,977,698 4/1961 Chamberlin ..... 40/159 X
3,940,778 2/1976 Craig et al. ..... 40/159 X
4,165,193 8/1979 Gestetner ..... 281/31 X
4,336,754 6/1982 Loeb ..... 281/31 X

FOREIGN PATENT DOCUMENTS 1536550 1/1970 Fed. Rep. of Germany ..... 281/31

*Primary Examiner*—Paul A. Bell
*Attorney, Agent, or Firm*—Richard L. Miller

[57] ABSTRACT

An address book foldable about a center fold line, and including pockets having pocket openings adjacent to the fold line, so that address labels, inserted into the pockets, cannot accidentally fall out.

2 Claims, 5 Drawing Figures

ADDRESS BOOK WITH INSERTED LABELS

JOHN DOE 327-118-1201
123 MAIN ST. N.Y. N.Y. 10070
MARY JONES

INSERTED LABELS - ADDRESS BOOK

This invention relates generally to folders for displaying address cards or labels.

BACKGROUND OF THE INVENTION

It is well known that numerous address books have been designed in the past. However all of these address books are designed to permanently retain an entry once the same is written there into. This is objectionable because when entries become obsolete they cannot be removed so that, in time, the address book must be discarded and replaced with a new one for more up-to-date entries. This situation is accordingly in need of improvement.

SUMMARY OF THE INVENETON

Therefore it is a principal object of the present invention to provide an address book in which labels may be inserted for display so that when the labels become obsolete, they may be readily pulled out and replaced with up-to-date labels, thus eliminating the need to discard the entire address book.

Another object is to provide an inserted labels address book which may be made in any desired size, and which may be retailed with a pack of insert labels cards for use therein.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures of the drawings are briefly described as follows.

DESCRIPTION OF PREFERRED EMBODIMENT

Figures 1, 2, 3, 4, 5:
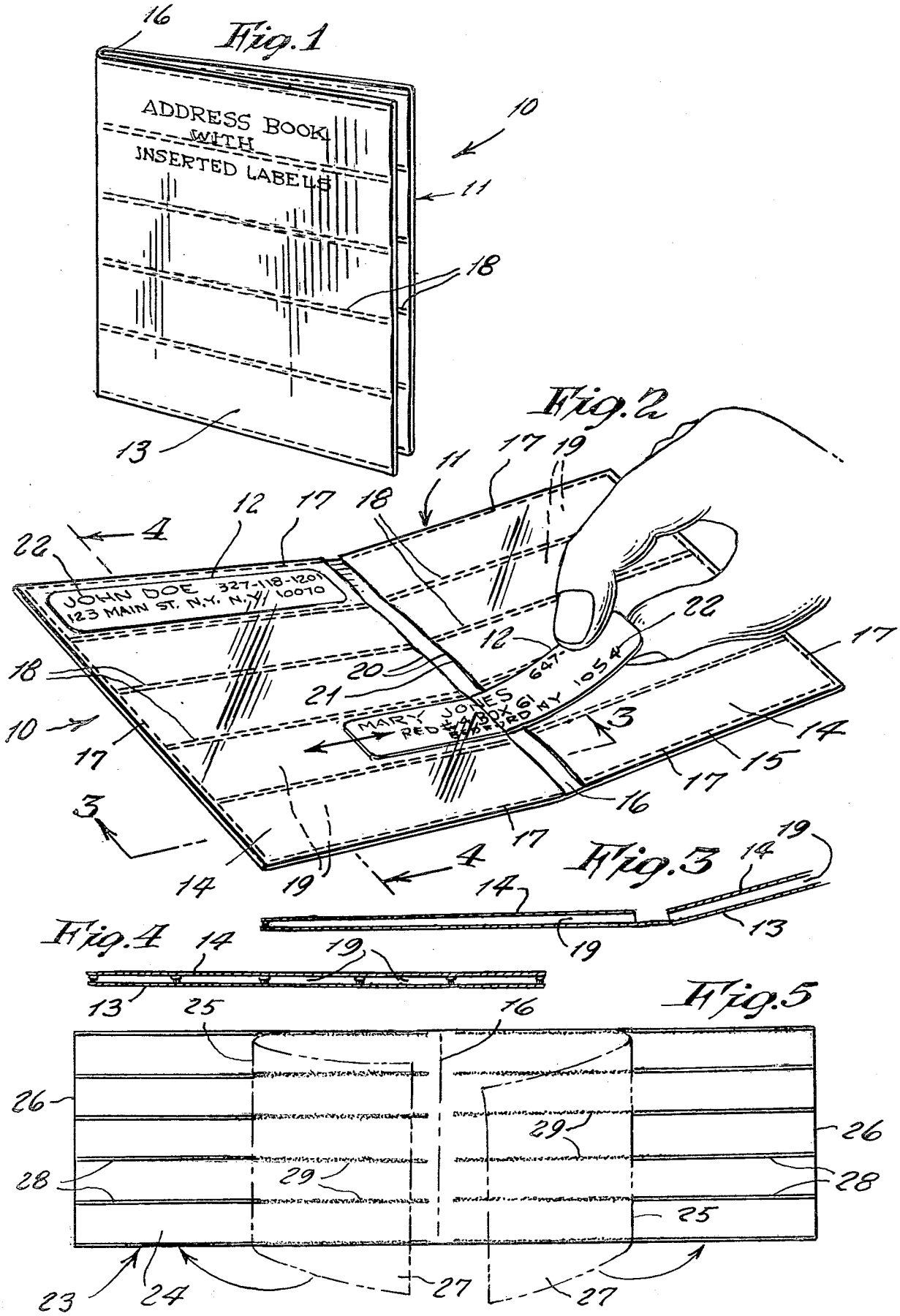
FIG. 1 is a perspective view of an address book using the label holder, shown closed.
FIG. 2 is a perspective view thereof, shown open, with an address label being inserted thereinto.
FIG. 3 is a cross sectional view on line 3—3 of FIG. 2.
FIG. 4 is a cross sectional view on line 4—4 of FIG. 2.
FIG. 5 is a flat pattern view showing the address label holder fully opened up.

Referrring now to the drawing in greater detail and more particularly to FIGS. 1 and 2 thereof, at this time the reference numeral 10 represents the assembled invention according to the present design wherein there is an address book 11 in which address labels 12 may be readily inserted for display therein.

The address book is made from an opaque, flexible plastic cover sheet 13 and two transparent, flexible plastic sheets 14 which may be sewn to the cover sheet by means of thread 15.

All of the sheets are rectangular in shape; the cover sheet being twice as large as the transparent sheets. The cover sheet is folded over a center fold line 16 and each of the transparent sheets is stitched to one of the inner sides of the cover sheet. The stitching includes stitches 17 along three outer edges of each transparent sheet and it also includes a plurality of parallel, equally spaced apart stitch rows 18 across each transparent sheet and across corresponding portions of the cover sheet in order to form a series of pockets 19 there between. A fourth edge 20 of each transparent sheet, facing the fold line 16, is left unstitched in order to form entry openings 21 for the pockets and through which the address labels may be inserted into or removed from the pockets, as shown in FIG. 2.

The address labels 12 are made from any suitable paper, cardboard or opaque plastic upon which addresses 22 or other information may be written so as to be displayed visually through the transparent sheet 14, when inside the pocket. The labels are made a size so as to easily fit into the pockets.

When the address book is folded over, as shown in FIG. 1, the labels cannot accidentally slide out of the pockets.

As shown in FIGS. 3 and 4, loop pile may be used instead of thread to hold the address book assembled. In a modified design of the invention, shown in FIGS. 3, 4 and 5, the address book 23 is made from a large, single sheet 24 of foldable, transparent plastic and which includes the center fold line 16, and additionally a fold line 25, parallel thereto, located midway between the fold line 16 and each opposite side edge 26 of the sheet in order to fold flaps 27 at each end, which are then secured, in folded over position, to a remainder of the sheet by means of corresponding loop pile fasteners 28 and 29 in order to form the above described pockets for the address labels. The advantage of this design is that it is less expensive to manufacture by not requiring an assembly of separate parts and permitting easy unsnapping and cleaning out of the pockets whenever so wished.

While certain novel features of this invention have been shown and described and are pointed out in the annexed claims, it wll be understood that various omissions, substitutions and changes in the forms and details of the device illustrated and in its operation can be made by those skilled in the art without departing from the spirit of the invention.

I claim:

1. An inserted labels address book, comprising in combination, a foldable address book and a plurality of address labels for insertion into said address book, said address book comprising a single elongated flat cover sheet having a left and right cover portion foldable about a center fold line, a page sheet of transparent material respectively overlaying each of said left and right cover portions, loop pile fastener material formed at the periphery of said left and right cover portions and said page sheets to peripherally retain the page sheet to its respective cover portion, and spaced apart elongated strips of loop pile fastener material formed between said page sheets and their respective cover portions, extending from a respective left and right side edge perpendicularly toward said center fold line to retain the page sheets to the cover portions along said elongated strips, and defining pockets between adjacent strips of loop pile fastener material which pockets have access openings facing said fold line, said pockets receiving said address labels, and wherein said page sheets are removable from their respective cover portions for cleaning out said pockets.

2. The combination as in claim 1, wherein said cover sheet is formed of transparent material, said page sheets being integral therewith and formed by folding over towards said center fold line the lateral sides of said left and right cover portions onto itself.

* * * * *